US006089666A

United States Patent [19]

Rosko

[11] Patent Number: 6,089,666

[45] Date of Patent: Jul. 18, 2000

[54] HIGH CHAIR HAVING RETRACTABLE ROLLERS

[75] Inventor: M. Scot Rosko, Greenwood, Ind.

[73] Assignee: Cosco, Inc., Columbus, Ind.

[21] Appl. No.: 09/160,486

[22] Filed: Sep. 25, 1998

Related U.S. Application Data

[60] Provisional application No. 60/060,069, Sep. 26, 1997.

[51] Int. Cl.[7] ..... A47C 1/02

[52] U.S. Cl. ..... 297/344.1; 297/118; 297/463.2; 16/44; 280/87.051; 280/47.38; 248/188.2; 248/685

[58] Field of Search ..... 297/344.1, 311, 297/153, 463.2; 248/188.2, 188.3, 688, 685; 16/32, 44; 280/30, 43, 47.38, 87.051

[56] References Cited

U.S. PATENT DOCUMENTS 1,749,751 3/1930 Bergsten ..... 16/44
3,096,536 7/1963 Rabelos ..... 16/44 X
3,216,048 11/1965 Jespersen ..... 16/44 X
5,421,636 6/1995 Gamble .
5,927,805 7/1999 Hilfer et al. ..... 297/153

*Primary Examiner*—Anthony D. Barfield
*Attorney, Agent, or Firm*—Barnes & Thornburg

[57] ABSTRACT

A juvenile high chair includes at least one leg. The leg comprises a foot having a bottom edge adapted to engage a surface underlying the foot, a roller, and a bracket having a first end coupled to the leg, a second end coupled to the roller, and a center flexible portion extending between the first and second ends. The first and second ends are substantially parallel to each other when a portion of the wheel engages the surface and displaces the bottom edge of the leg from the surface.

34 Claims, 12 Drawing Sheets

HIGH CHAIR HAVING RETRACTABLE ROLLERS

This application claims benefit of Provisional Appl. 60/060,069, filed Sep. 26, 1997.

BACKGROUND AND SUMMARY OF THE INVENTION

The present invention relates to a high chair, and more particularly, to a high chair having a frame with rollers that allow the high chair to be rolled along a surface such as a floor. More particularly, the present invention relates to a high chair having a retractable roller assembly.

High chairs are often used by caregivers to provide a convenient place for a juvenile to sit. To enable a high chair to be mobile, a high chair may be mounted on rollers to allow the high chair to be rolled along the floor. See, for example, U.S. Pat. No. 5,421,636 to Gamble.

According to the present invention, a juvenile high chair includes a frame having a front frame member with opposite front feet, a back frame member pivotably coupled to the front frame member, and a seat. A retractable roller assembly is coupled to each of the front feet. Each retractable roller assembly includes a bracket pivotably coupled to the respective front foot and a roller coupled to the bracket. The retractable roller assembly allows the high chair to be rolled along a surface such as a floor upon the rollers when the seat of the high chair is unoccupied. However, when the seat is occupied by a juvenile, the bracket pivots to allow the roller to retract into a cavity formed in each front foot. In this position, the front foot engages the floor so that friction between the front foot and the floor blocks the roller from rolling along the floor.

In preferred embodiments, the high chair also includes a plate that prevents the high chair from bouncing as it rolls along the rollers. The plate preloads the bracket to a position that prevents the roller from retracting into the cavity until a downward force greater than that of the weight of the chair is applied to the high chair.

The high chair frame also has two back feet spaced apart from the two front feet. When the high chair is unoccupied (i.e., there is no juvenile sitting in the high chair), the back feet rest securely on the floor and the front feet ride a few inches above the floor on the rollers. To move the unoccupied high chair, a caregiver can raise the back legs of the high chair off the floor and roll the high chair on the rollers mounted to the front feet. When the caregiver has positioned the high chair in the desired location, the caregiver can lower the back feet back down to the floor and place a juvenile into the high chair. The weight of the juvenile causes the frame of the high chair to move downwardly. Because the rollers on the front feet are retractable, the rollers retract into the cavities formed in the front feet so that the front feet rest on the floor and the rollers are hidden from view.

In other embodiments, retractable rollers are coupled to the rear feet in addition to the front feet. The rollers on the rear feet include caster wheels and the rollers on the front feet include caster wheels or bidirectional wheels.

Additional features and advantages of the invention will become apparent to those skilled in the art upon consideration of the following detailed description of preferred embodiments of the invention exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
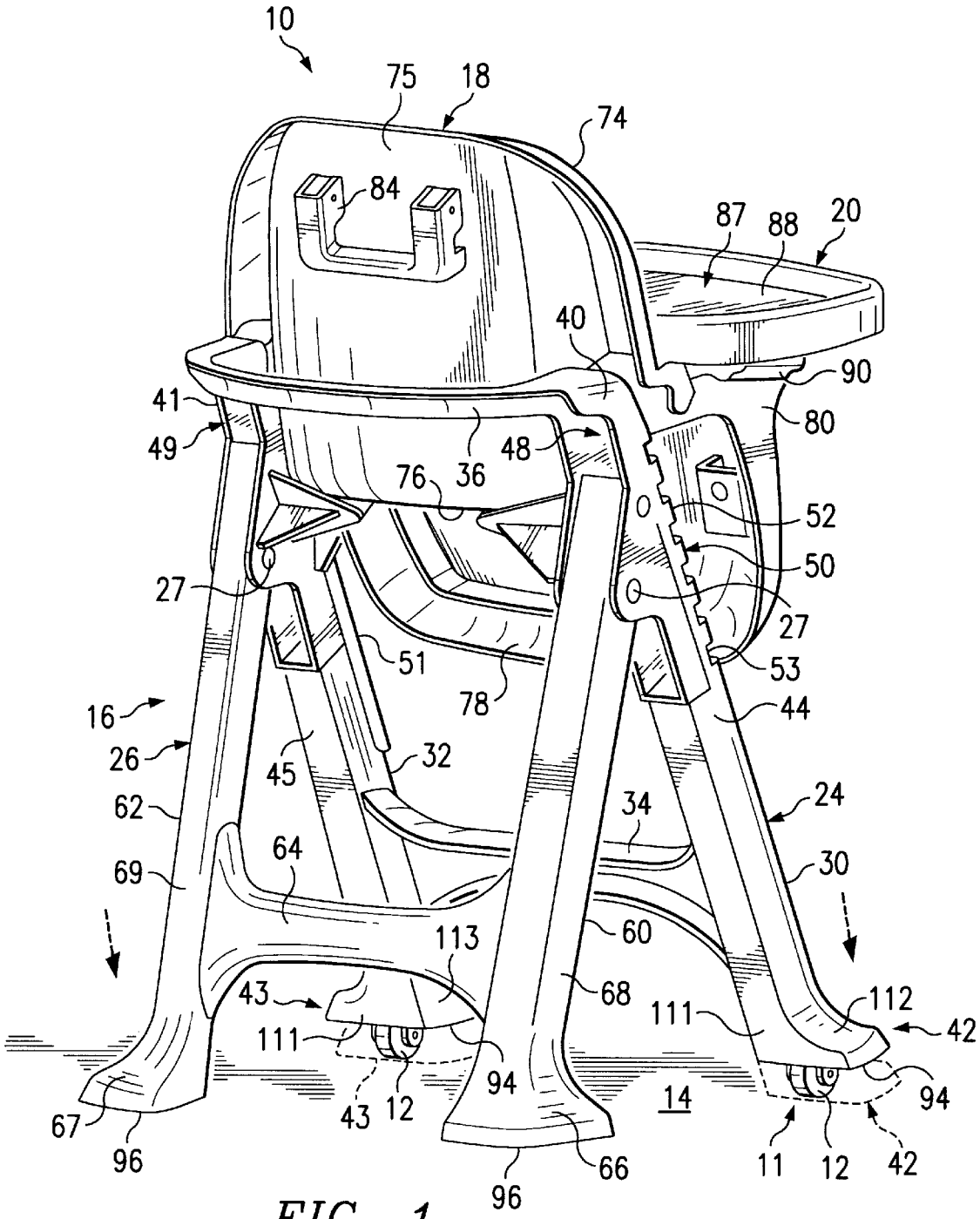
FIG. 1 is a rear perspective view of a juvenile high chair in accordance with the present invention, the high chair including a frame having a front frame member with opposite front feet, a back frame member pivotably coupled to the front frame member, a seat mounted on the front frame member, and a retractable roller coupled to each of the front feet, showing the rollers supporting the high chair in an elevated position where the front frame member is positioned at a predetermined distance above a floor when the high chair is unoccupied and showing (in phantom) the high chair in a lowered position with the front feet resting on the surface when, for example, a juvenile (not shown) is placed in the seat of the high chair.
Figure 2:
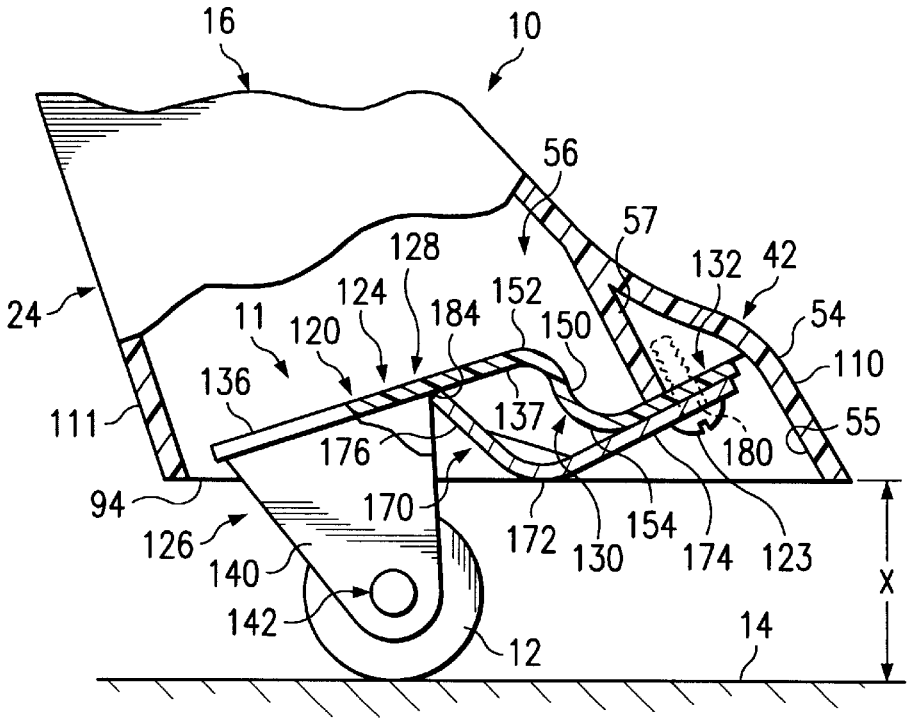
FIG. 2 is an enlarged side view of one of the front feet of FIG. 1, with portions broken away, showing the front foot including an inner wall defining the cavity, a bracket including a frame mount coupled to the inner surface and a roller mount extending from the frame mount through the cavity, the roller being a wheel coupled to the roller mount, and a plate coupled to the frame mount of the bracket to preload the bracket to a predetermined position to support the front foot at a predetermined distance above the floor.
Figure 3:
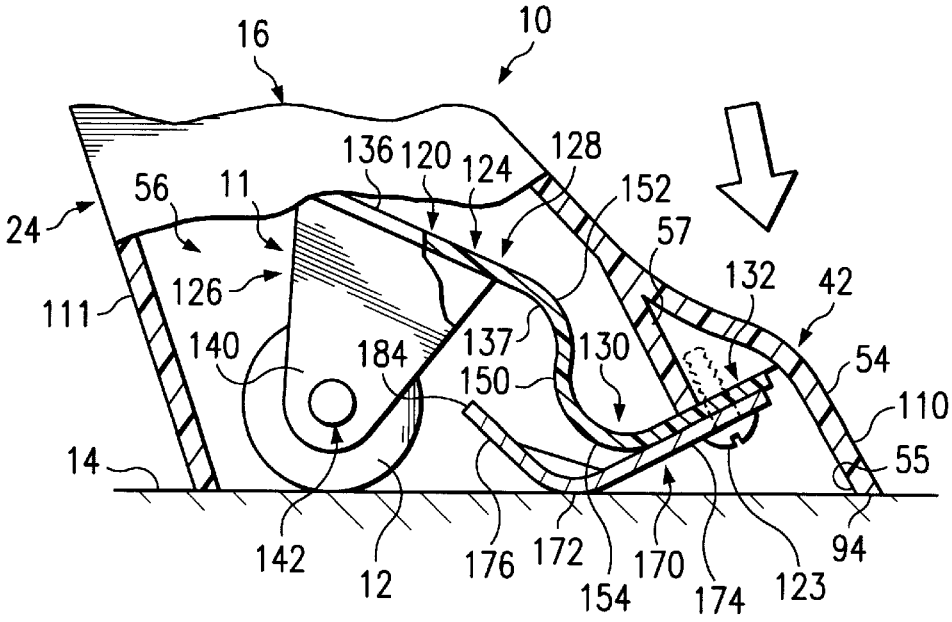
FIG. 3 is a view similar to FIG. 2 showing the wheel being retracted into the cavity of the front foot after the frame has moved downwardly to, for example, the phantom position shown in FIG. 1, the bracket flexing upwardly away from the plate to allow a bottom surface of the front foot to rest upon the floor.

A juvenile high chair 10 is shown in FIGS. 1–3. High chair 10 includes a frame 16 having a front frame member 24, with opposite front feet 42, 43, a back frame member 26 coupled to front frame member 24 and a seat 18 coupled to front frame member 24. In addition, a retractable roller assembly 11 is coupled to front feet 42, 43 to support frame 16 on a surface such as a floor 14. 15 Roller assembly 11 is movable between an expanded position, as shown in FIG. 1, and a retracted position, shown in phantom in FIG. 1. When roller assembly 11 is in the expanded position, each roller 12 of roller assembly 11 is spaced-apart from front feet 42, 43 as shown in FIGS. 1 and 2. At this time, back feet 66, 67 rest on floor 14 while front feet 42, 43 are spaced-apart from floor 14. However, when roller assembly 11 is in the retracted position, as shown in phantom in FIG. 1 and in FIG. 3, each roller 12 is housed within a cavity 56 defined by front feet 42, 43. At this time both front and back feet 42, 43 and 67, 69 rest on floor 14. Although only front foot 42 will be discussed hereafter, it is understood that the following description applies to front foot 43 as well.

Figure 4:
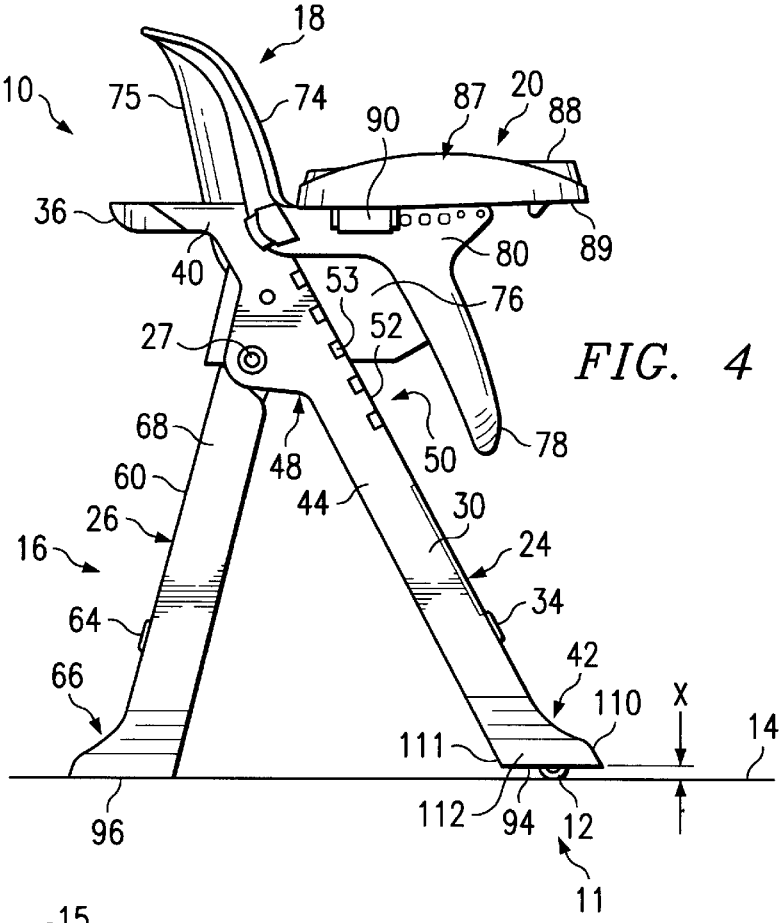
FIG. 4 is a side elevation view of the high chair of FIG. 1 showing the high chair being unoccupied, the wheels supporting the front frame member so that the bottom surfaces of the front feet ride at a predetermined distance above the floor, and the back feet resting on the floor.
Figure 5:
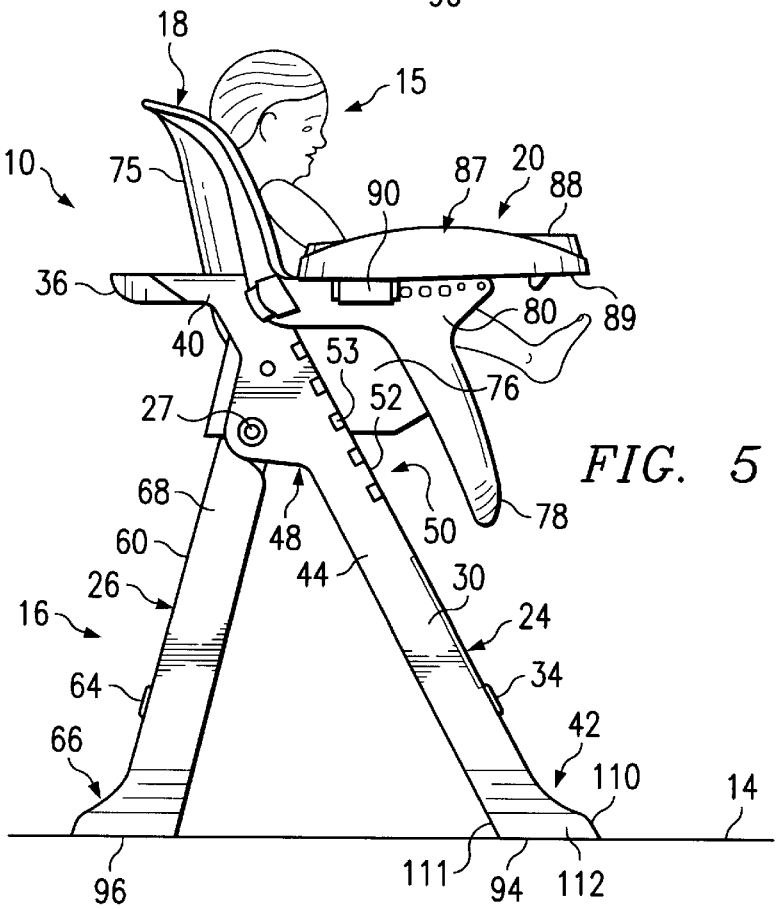
FIG. 5 is a view similar to FIG. 3 showing the high chair being occupied by a juvenile, the weight of the juvenile causing the frame to move downwardly, retracting the wheels to within the cavity of the respective front foot, the occupied chair thus being in a fixed position with the front and back feet resting on the floor.
Figure 6:
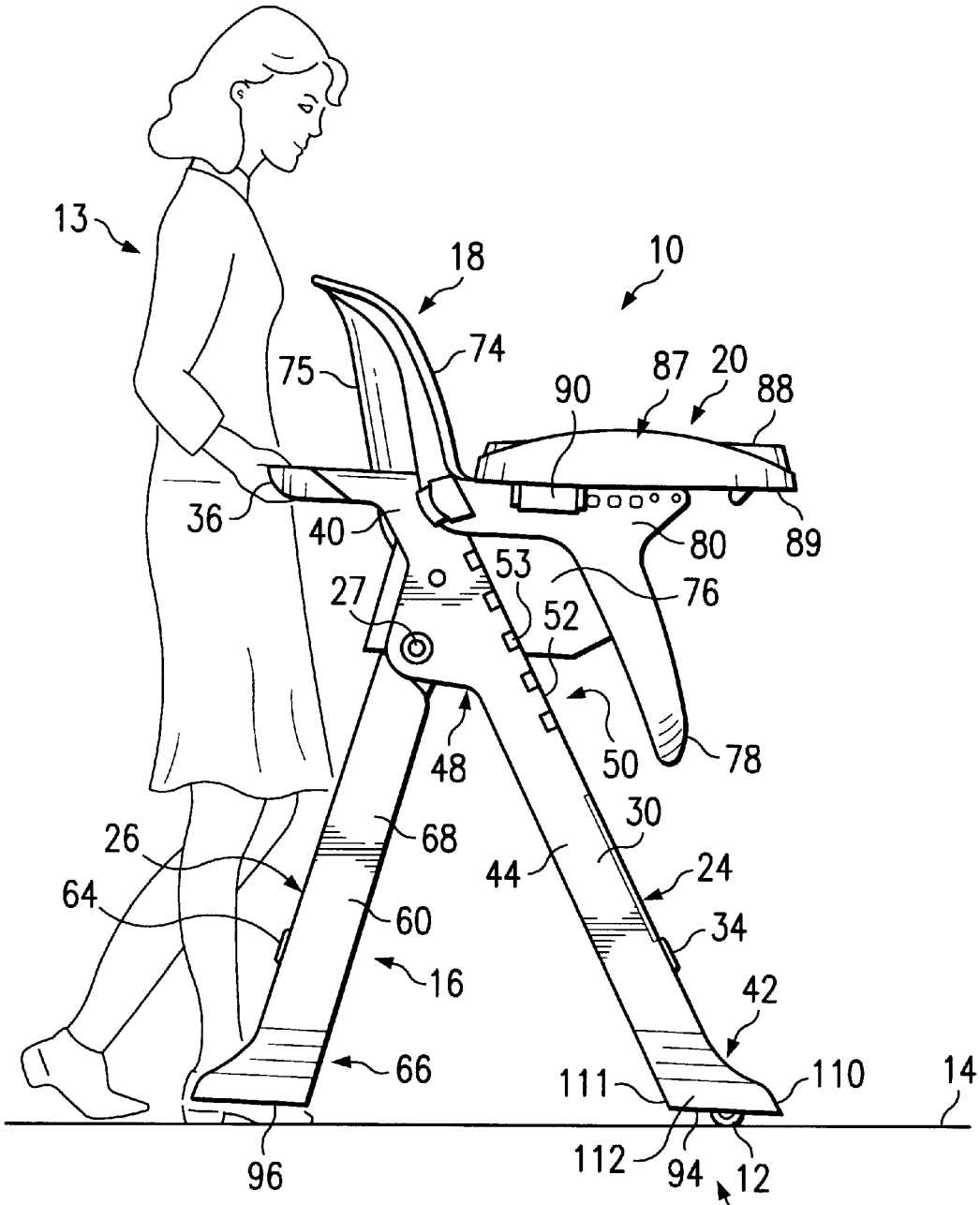
FIG. 6 shows the high chair of FIG. 4 after a caregiver has lifted the back frame member off the floor to allow the unoccupied high chair to be moved on the wheels.

Referring now to FIGS. 2 and 3, roller assembly 11 includes a bracket 120 pivotably coupled to front foot 42, a roller 12 coupled to bracket 120, and a plate 170. Roller assembly 11 is positioned in the expanded position when seat 18 is unoccupied, as shown in FIG. 4. In the expanded position, bracket 120 positions roller 12 a predetermined distance X from floor 14. When seat 18 is occupied by a juvenile 15, as shown in FIG. 5, front foot 42 engages floor 14, pivoting roller assembly 11 to the retracted position, such that friction between front foot 42 and floor 14 prevents roller 12 from rolling along floor 14. In fact, due to the frictional engagement between back feet 66, 67 and floor 14, even when seat 18 is unoccupied, roller 12 only rolls along floor 14 once a caregiver 13 has lifted back frame member 26 off of floor 14 as shown in FIG. 6. Only in this position is caregiver 13 free to push high chair 10 on rollers 12 along floor 14.

Figure 7:
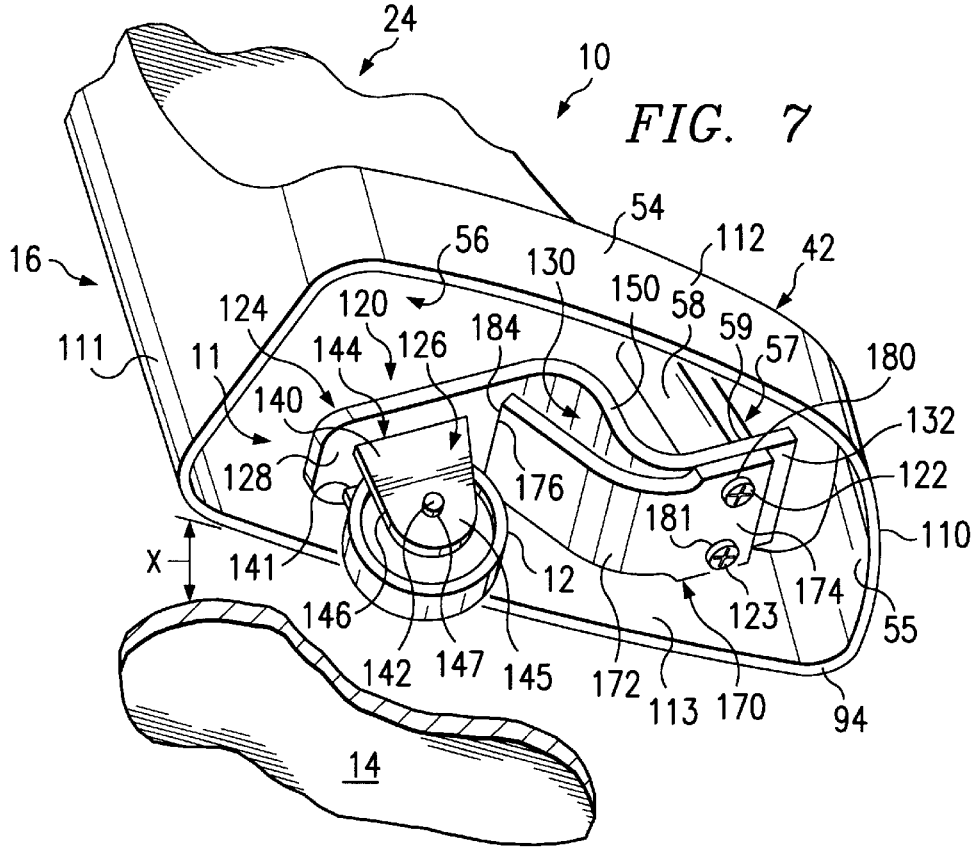
FIG. 7 is a bottom perspective view of the right front foot of FIG. 1 showing the roller mount of the bracket extending out from the cavity and wheel, which is coupled to the roller mount, supporting the high chair at the predetermined distance above the floor.
Figure 8:
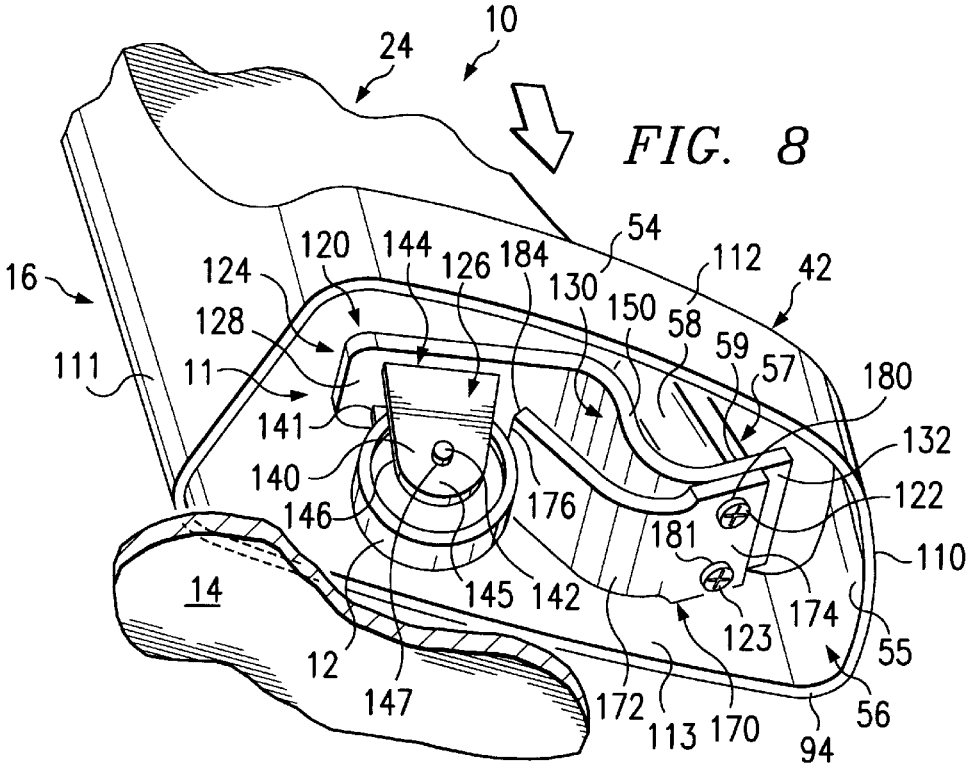
FIG. 8 is a view similar to FIG. 7 showing the high chair being pushed downwardly (e.g., being occupied) so that the frame mount of the bracket flexes inwardly retracting the wheel into the cavity of the front foot so that the bottom surface of the front foot rests on the floor.

As shown in FIGS. 7 and 8, front foot 42 of front frame member 24 includes a front wall 110, a rear wall 111, and side walls 112, 113 extending between front and rear walls 110, 111. Walls 110–113 define an outer surface 54, an inner surface 55, and a bottom surface 94 interconnecting outer and inner surfaces 54, 55. Inner surface 55 defines cavity 56 that houses retractable rollers 12 as shown in FIGS. 2 and 3. Front foot 42 further includes a screw receptacle 57 extending from inner surface 55 into cavity 56. Receptacle 57 includes a side wall 58 and an end 59. Screw receptacle 57 will be discussed in more detail below.

Figure 9:
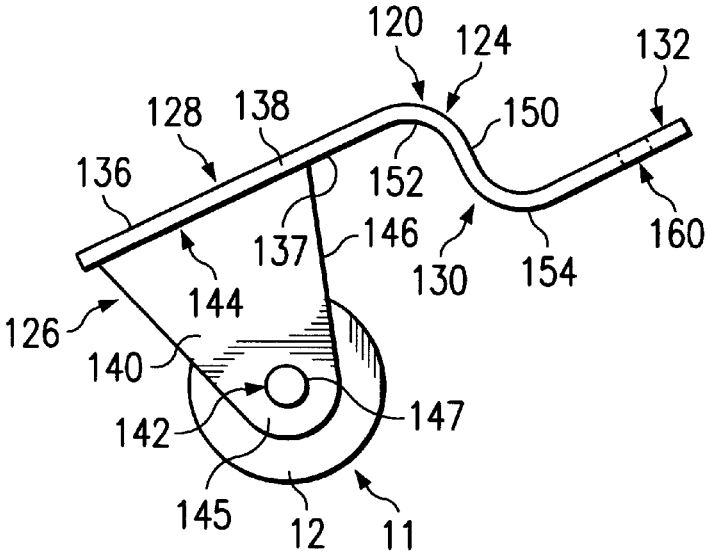
FIG. 9 is a side view of the bracket and roller of FIGS. 7 and 8 disassembled from the frame showing the frame mount of the bracket having a generally Z-shaped center portion.

As shown in FIGS. 7 and 8, bracket 120 is coupled to front foot 42 of high chair 10. Bracket 120 is mold-formed from a polycarbonate material and includes a frame mount 124 and a roller mount 126 extending from frame mount 124. Frame mount 124 includes a top surface 136, a bottom surface 137, and a side surface 138 interconnecting the top and bottom surfaces 136, 137. Top, bottom, and side surfaces 136, 137, 138 of frame mount 124 are formed to define an outer end 128 adjacent to roller mount 126, an inner end 132 coupled to receptacle 57, and a flexible portion 130 extending therebetween. As shown in FIG. 9, outer end 128 and inner end 132 are separated by flexible portion 130 and are normally substantially parallel to one another when bracket 120 is not coupled to high chair 10. Outer end 128 of frame mount 124 is substantially flat and is designed to couple with roller mount 126.

Flexible portion 130 includes a generally flat central portion 150 and a pair of curved ends 152, 154. First curved end 152 interconnects outer end 128 and central portion 150 of flexible portion 130. As shown in FIG. 9, first curved end 152 curves downwardly away from outer end 128 so that central portion 150 is substantially perpendicular to outer end 128. Second curved end 154, as shown in FIG. 9, extends outwardly from central portion 150 so that inner end 132 is substantially perpendicular to central portion 150 and substantially parallel to outer end 128.

Inner end 132 connects bracket 120 to front foot 42. Inner end 132 is formed to include a pair of holes 160 sized to receive screws 122, 123 therethrough to connect bracket 120 to front foot 42. Holes 160 are positioned to lie in a spaced-apart relation to one another as evident from FIGS. 7 and 8 so that bracket 120 is blocked from side-to-side movement or rotation. Screws 122, 123 are designed to hold top surface 136 of inner end 132 to end 59 of screw receptacle 57.

As shown in FIGS. 7 and 8, roller mount 126 extends from bottom surface 137 of frame mount 124 through cavity 56. Roller mount 126 includes a pair of tabs 140, 141 coupled to roller 12. Tabs 140, 141 each include a fixed end 144 coupled to bottom surface 137, an opposite free end 145 and side walls 146 converging from fixed end 144 toward free end 145. As shown in FIG. 7, a rivet 142 extends through an aperture 147 formed in tabs 140, 141 adjacent to free end 145 to couple roller 12 on bracket 120. Although tab 141 is only partially shown, tab 141 is identical to tab 140.

As shown in FIG. 9, each rivet 142 is positioned in a spaced-apart relation to outer end 128. Tabs 140, 141 are positioned to lie substantially parallel to one another and rivets 142 are located at substantially the same location on their respective tabs 140, 141 so that roller 12 can be connected between tabs 140, 141 using rivets 142. With roller 12 connected between tabs 140, 141, roller 12 can rotate about an axis defined by rivets 142, 143 between tabs 140, 141. As such, roller 12 is a wheel because roller 12 can only roll forward and backward relative to frame 16 and cannot swivel about an axis perpendicular to the axis of the wheel as do casters. Thus, as used herein, "roller" means any wheel, caster, or other revolving cylinder over or on which something is moved, whereas wheels are unidirectional (forward and backward) and casters swivel (as described below).

Plate 170 is used to preload bracket 120 to a predetermined starting position as shown best in FIGS. 2 and 7. Plate 170 is preferably formed from a rigid material such as steel and includes a curved body 172, a frame-mount portion 174, and a tip 176. Body 172 interconnects frame-mount portion 174 and tip 176. Body 172 is tapered inwardly from frame-mount portion 174. Frame-mount portion 174 is formed to include a pair of holes 180, 181, so that screws 122, 123 can extend through holes 180, 181 to connect plate 170 against bracket 120 to frame 16. Holes 180, 181 of frame-mount portion 174 must be spaced apart in exactly the same manner as holes 160 of inner end 132 of bracket 120 so that screws 122, 123 can extend through both bracket 120 and plate 170 as shown in FIG. 7. Tip 176 includes a corner surface 184 that pushes upwardly on outer end 128 of bracket 120. This force exerted on bracket 120 causes bracket 120 to be in a pre-loaded position as shown in FIG. 2 when high chair 10 is unoccupied as shown in FIG. 4.

Plate 170 prevents a "bouncy" feel to high chair 10 when the brackets 120 of high chair 10 are not sufficiently rigid. Plates 170 are preferably preloaded to more than the weight of chair 10 so that, as shown in FIG. 6, a caregiver can pick up frame 16 using handle 36 to raise back feet 66, 67 off of floor 14 to move high chair 10 to a desired location. Plates 170 position flexible portion 130 of bracket 120 in a more rigid position.

As shown in FIG. 1, front frame member 24 includes a right leg 30, a left leg 32, a lower support member 34, and an upper handle 36. Right and left legs 30, 32 each include an upper portion 40, 41, a lower foot portion or front feet 42, 43, and an elongated portion 44, 45. Upper portions 40, 41 of right and left legs 30, 32 are connected to one another by upper handle 36. Similarly, lower support member 34 interconnects and provides support for elongated portions 44, 45. Each elongated portion 44, 45 includes a rear face 48, 49 that faces back frame member 26 and an opposite front face 50, 51. A plurality of tabs 52 are formed in each front face 50, 51 of elongated portions 44, 45 to define a plurality of slots 53 therebetween to mount seat 18 to frame 16.

Right and left legs 30, 32 are hollow and each has substantially uniform cross-sections along most of the length of elongated portions 44, 45 and enlarged cross-sections at the lower foot portions or front feet 42, 43. Back frame member 26 is pivotally connected to front frame member 24 using a frame screw 27. Front and back frame members 24, 26, however, may also be joined by a pin, rivet, rod, or comparable connection mechanisms. Back frame member 26 includes a right leg 60, a left leg 62, and a lower support member 64 interconnecting right leg 60 and left leg 62. Right and left legs 60, 62 each include a lower foot portion 66, 67 (also referred to as back feet 66, 67), and an elongated portion 68, 69. Right and left legs 60, 62 each have substantially uniform cross-sections along most of the length of elongated portions 68, 69 and enlarged cross-sections at the lower foot portions 66, 67. Back feet 66, 67 each have a bottom surface 96 which normally rests on floor 14 as shown in FIG. 1.

Seat 18 of high chair 10 is movable on frame 12 as described in U.S. patent application Ser. No. 09/092,216, entitled "Juvenile Chair," which is incorporated herein by reference. Seat 18 includes a seat bottom 76, a seat back 74 extending upwardly from seat bottom 76, and elevated arms 80, 81 extending between seat bottom 76 and seat back 74 to support a tray assembly 20. After seat 18 is mounted on frame 16, seat 18 may slide on front frame member 24 as desired by a caregiver, as described in the above-referenced application. A foot rest 78 can also be attached onto and detached from seat 18 as described in the above-referenced application. Seat 18 is also formed to include a handle 84 pivotally connected to a back side 75 of seat back 74. Handle 84 allows seat 18 to be mounted on frame 12 in a reclined position as described in the above-referenced application. While seat 18 is illustrated and described, a wide variety of seats may be used with high chair 10.

Tray assembly 20 is mounted to arms 80, 81 of seat 18 and is configured to slide relative to seat 18 as described in U.S. patent application Ser. No. 09/092,217 entitled "Release Mechanism For Tray" and U.S. patent application Ser. No. 09/092,126 entitled "Tray Assembly With Crotch Post," which are incorporated herein by reference. Tray assembly 20 provides a tray 87 and two latches 90 for coupling tray 87 to seat 18. Latches 90 enable the caregiver to use either one or both of their hands to mount and remove tray 87 from seat 18. Tray 87 includes an upper surface 88 for receiving items such as juvenile toys, food, or other such items (not shown) and a lower surface 89 facing seat bottom 76 of seat 18. Latches 90 are configured to release tray 87 from seat 18 to enable the caregiver to slide tray 87 on arms 80, 81 as described in the above-referenced applications. While tray assembly 20 is illustrated and described, a wide variety of tray assemblies may be used with high chair 10.

The operation of high chair 10 having retractable rollers 12 is shown in FIGS. 4–6. As shown in FIG. 4, when high chair 10 is unoccupied, high chair 10 is in a ready-to-be-moved position. High chair 10 will not freely roll on rollers 12, however, until the bottom surfaces 96 of back feet 66, 67 are raised off the floor as shown in FIG. 6. Retractable roller 12 can best be seen in FIGS. 2 and 7 with high chair 10 in the raised position. In the raised position, rollers 12 are in an extended position wherein rollers 12 are positioned to lie outside cavity 56. Plate 170 also holds bracket 120 in the predetermined position so that bottom surfaces 94 of front feet 42, 43 are at a predetermined distance X above floor 14.

As mentioned above, plates 170 are designed to preload to more than the weight of high chair 10 so that a downward force, such as a juvenile sitting in high chair 10, will bend bracket 120 and rollers 12 will retract. Thus, when a juvenile 15 is positioned in high chair 10 as shown in FIG. 5, bracket 120 moves away from plate 170 and rollers 12 assume a retracted position relative to front feet 42, 43 as shown in FIG. 3. In the retracted position, rollers 12 and bracket 120 are contained entirely within cavity 56 and bottom surface 94 of front feet 42, 43 rests on floor 14. This complete containment of rollers 12 prevents dirt, food, and other small particles (not shown) from interfering with the operation of bracket 120 and rollers 12 while rollers 12 are in the retracted position.

Because plate 170 is made of a rigid material such as steel and is contained within cavity 56, plate 170 does not move when additional weight is applied downward to high chair 10 such as a juvenile 15 occupying high chair 10. Bracket 120, however, bends upwardly due to the configuration of flexible portion 130 so that high chair 10 can move downwardly, causing bottom surfaces 94 to engage floor 14 and rollers 12 to be hidden from view.

Figure 10:
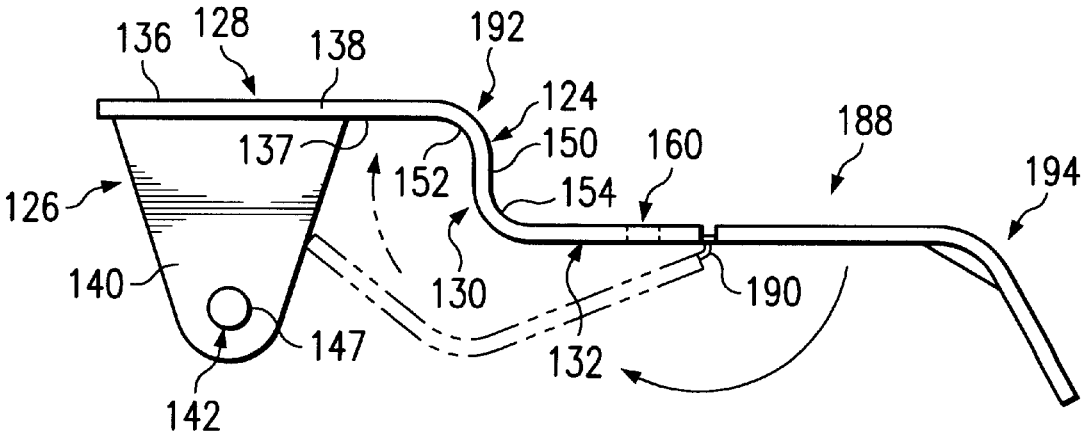
FIG. 10 is a view of a bracket and plate subassembly in accordance with the present invention showing subassembly including a bracket having a frame mount and a wheel mount and plate coupled to the frame mount by a living hinge so that the bracket and plate can be formed from the same material.

Although plate 170 is preferably made of a rigid material such as steel, plate 170 can also be formed of a polycarbonate material. As shown in FIG. 10, a combination bracket/plate 188 in accordance with an alternative embodiment of the present invention is molded from the same piece of polycarbonate material and separated by a living hinge 190. In this embodiment, combination bracket/plate 188 includes a roller portion 192 and a plate portion 194 separated by living hinge 190. Roller portion 192 is identical to bracket 120 shown in FIG. 9. Plate portion 194 is also substantially the same in structure as plate 170 except that plate portion 194 is made from a polycarbonate material instead of a rigid material.

A second embodiment of a high chair 210 is shown in FIGS. 11–20. High chair 210 of the second embodiment is identical to high chair 10 except that high chair 210 has rollers 212 mounted to back feet 66, 67 in addition to rollers 12 mounted to front feet 42, 43. In addition, rollers 212 are casters, instead of wheels, which are able to swivel about an axis perpendicular to the axis of rotation of the caster. Accordingly, the same numbering is used for both the first and second embodiments except as described below.

Figure 12:
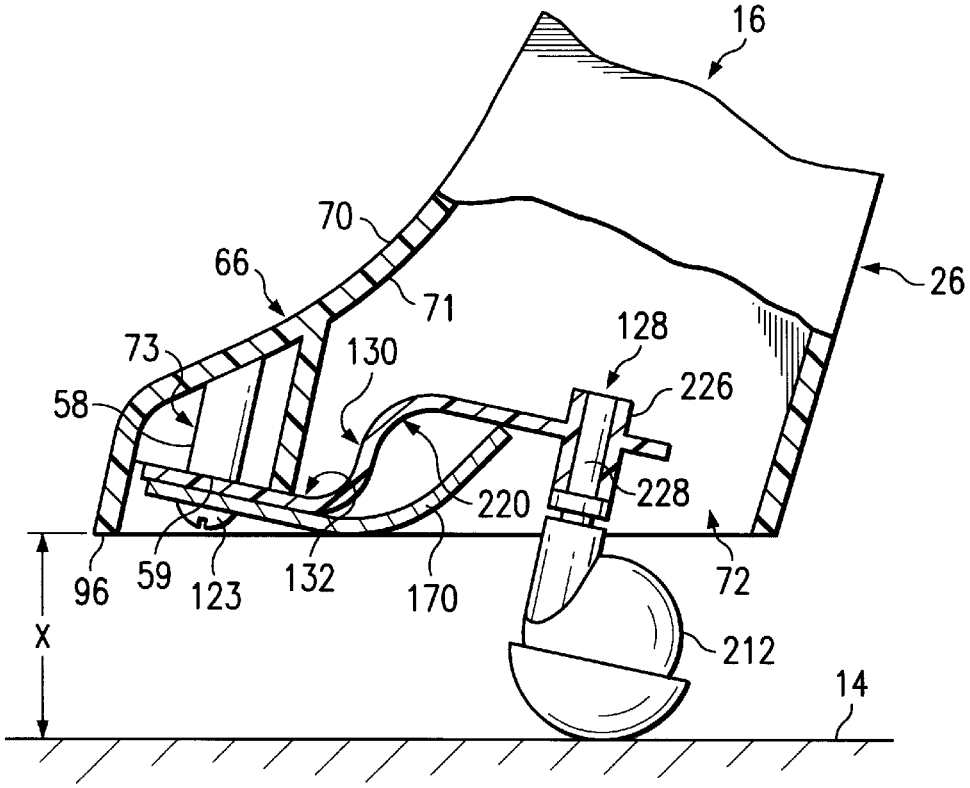
FIG. 12 is an enlarged side view of one of the back feet of FIG. 11, with portions broken away, showing the back foot including an inner wall defining a cavity, a bracket including a frame mount coupled to the inner surface and a roller mount extending from the frame mount through the cavity, the roller being a caster coupled to the roller mount, and a plate coupled to the frame mount of the bracket to preload the bracket to a predetermined position to support the back foot at a predetermined distance above the floor.
Figure 13:
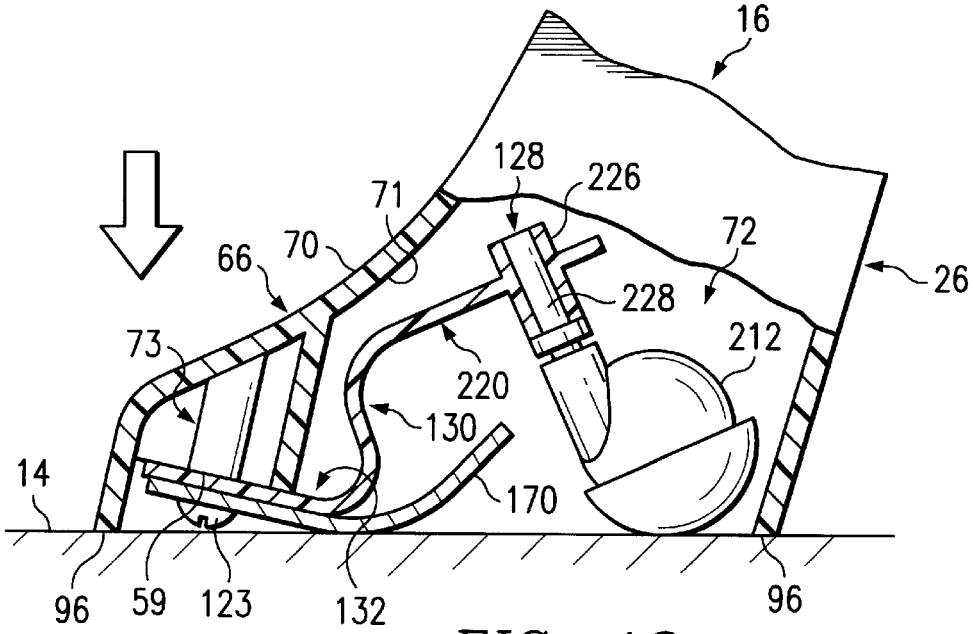
FIG. 13 is a view similar to FIG. 12 showing the roller being retracted into the cavity of the back foot after the frame has moved downwardly, the bracket flexing upwardly away from the plate to allow a bottom surface of the foot to rest upon the floor.

Like front feet 42, 43, the enlarged cross-sections of back feet 66, 67 allow retractable rollers 212 to be housed in back feet 66, 67. Back feet 66, 67 each include an outer surface 70, an inner surface 71, and bottom surface 96 interconnecting outer and inner surfaces 70, 71. Inner surface 71 is formed to define a cavity 72 to house retractable rollers 212, as shown in FIGS. 12 and 13. Front feet 42, 43 and back feet 66, 67 are substantially the same structure although they face opposite directions and are positioned on opposite sides (front and rear) of high chair 210. Each inner surface 71 of back feet 66, 67 is also formed to include screw receptacle 73. Screw receptacle 73, as shown in FIGS. 12–13, allows rollers 212 to be mounted to inner surfaces 71. Screw receptacle 73 is identical to screw receptacle 57 shown in FIGS. 7 and 8. Thus, screw receptacles 73 each include cylindrical side wall 58 and end 59.

Figure 11:
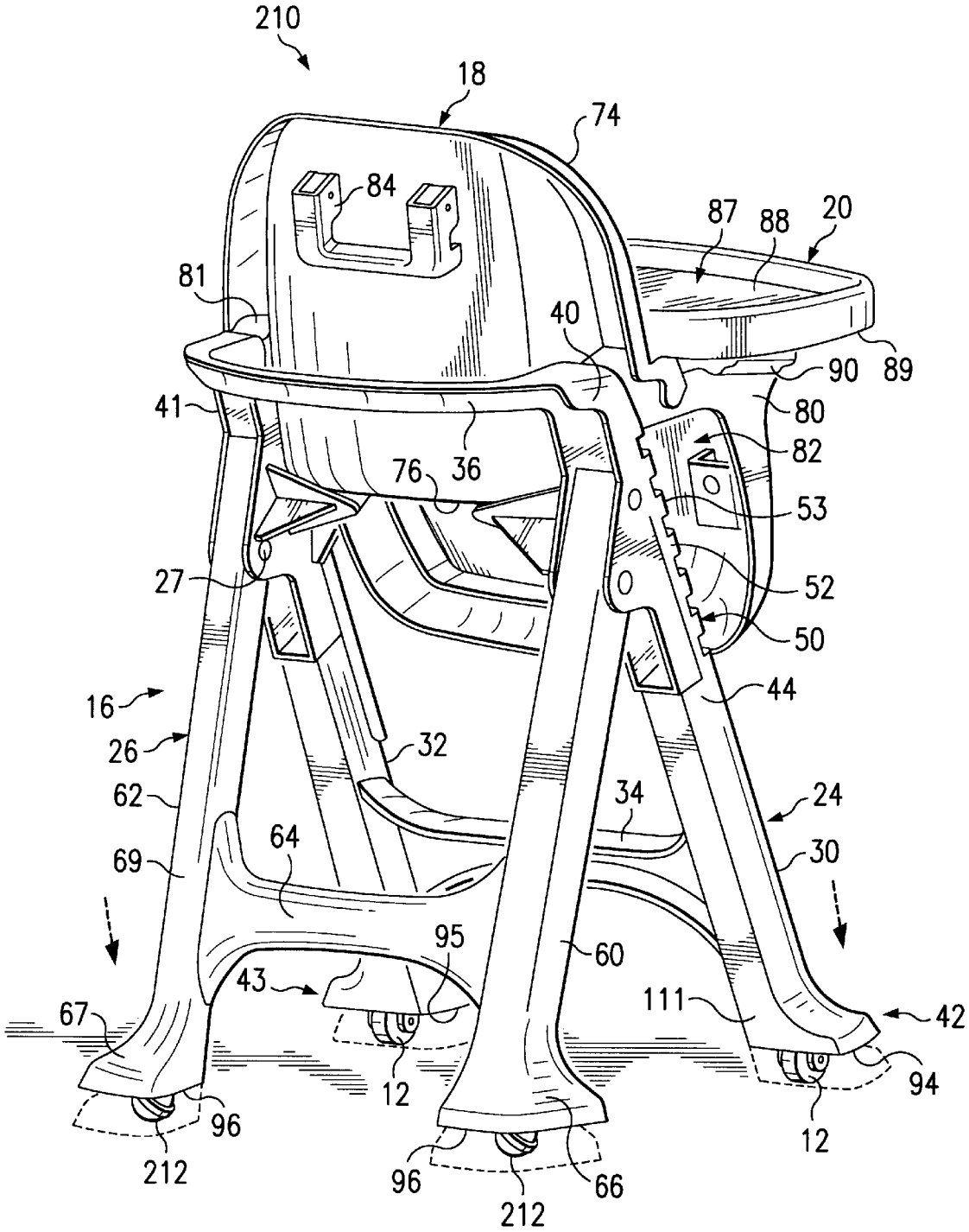
FIG. 11 is a rear perspective view of a juvenile high chair in accordance with the present invention including a frame similar to the frame of FIG. 1 and a retractable roller mounted to each front and back foot, the rollers mounted to the back feet being casters and the rollers mounted to the front feet being wheels.

As shown in FIGS. 11–13, a bracket 220 is used to mount rollers 212 to back feet 66, 67. As shown in FIG. 12, outer end 128 of bracket 220 includes a roller mount 226 that includes a cylindrical body 228. Body 228 allows roller 212 to snap into connection with bracket 220. Bracket 220 has an inner end 132 mounted to end 59 of screw receptacle 73. Plate 170 is mounted to bracket 220 to pre-load bracket 220 in a slightly compressed position. Plate 170 acts upon roller 212 as was previously discussed with roller 12.

Figure 16:
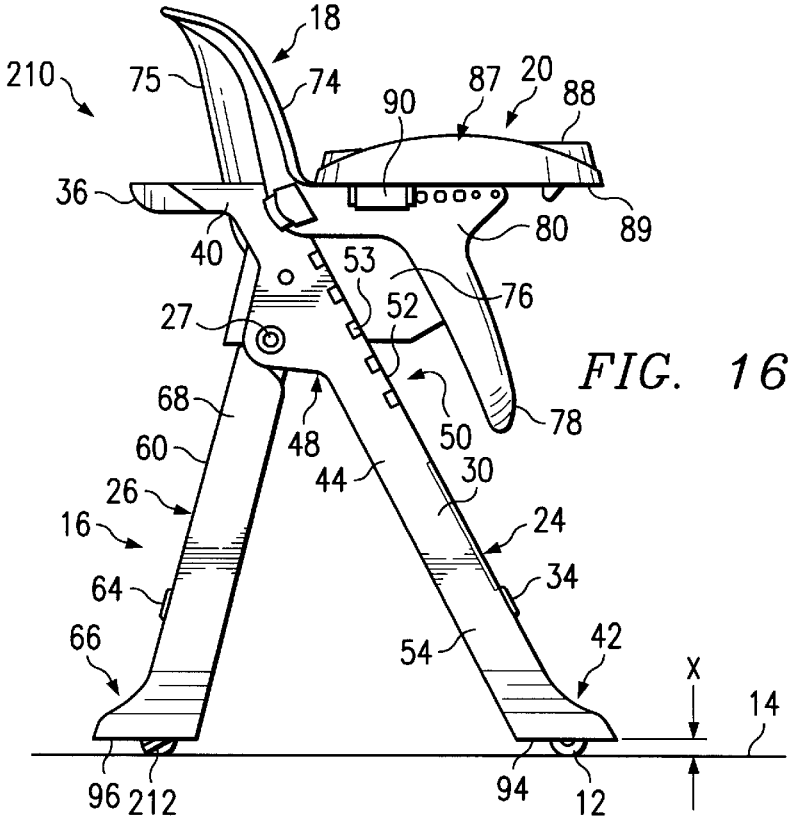
FIG. 16 is a side elevation view of the high chair of FIG. 11 showing the high chair being unoccupied, the front legs being supported by wheels, and the rear legs being supported by casters so that the bottom surfaces of the front and rear legs ride at a predetermined distance above the floor.
Figure 18:
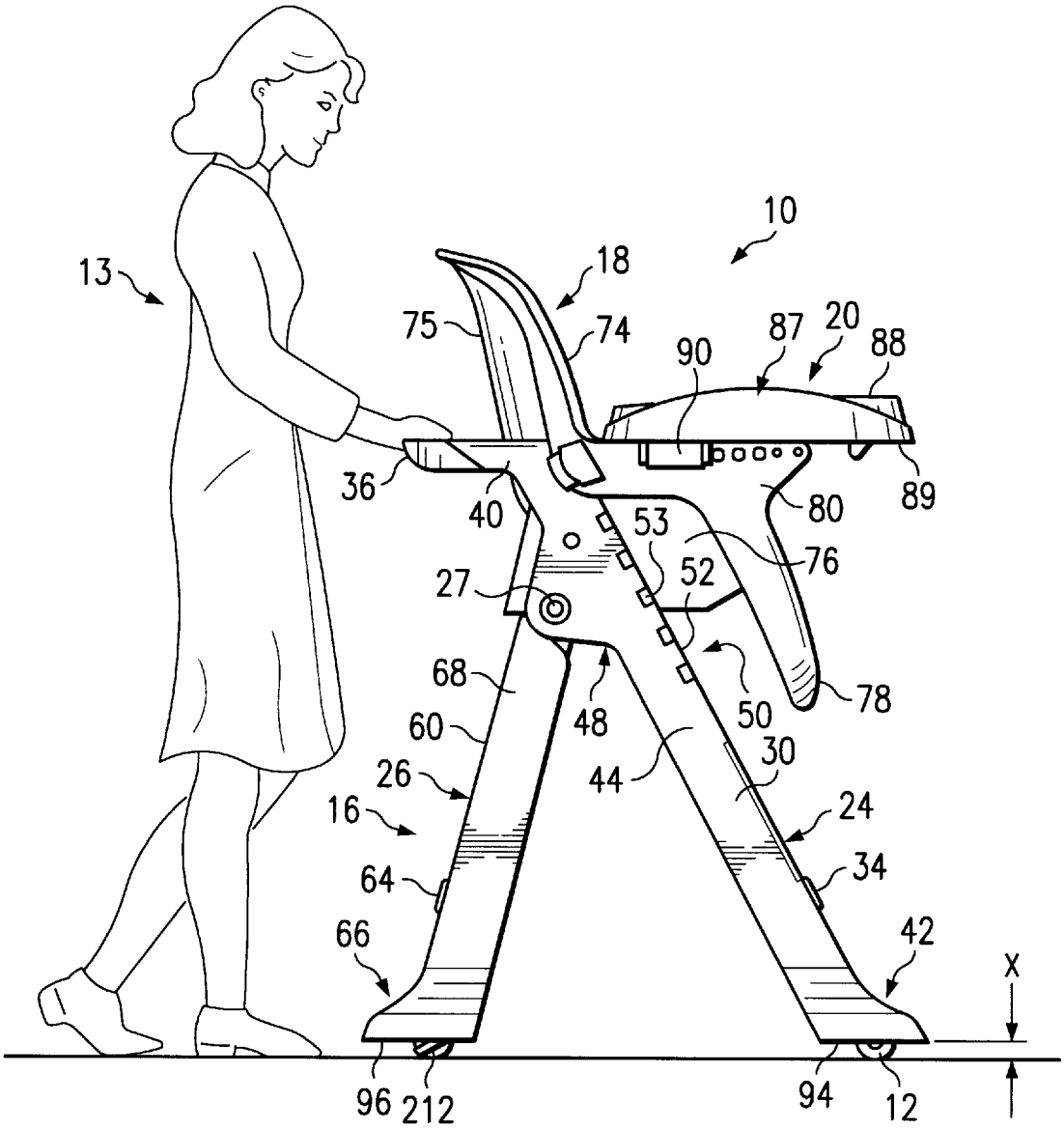
FIG. 18 is a view similar to FIG. 16 showing a caregiver being able to move the high chain on the caster and wheels when the high chair is unoccupied.
Figure 19:
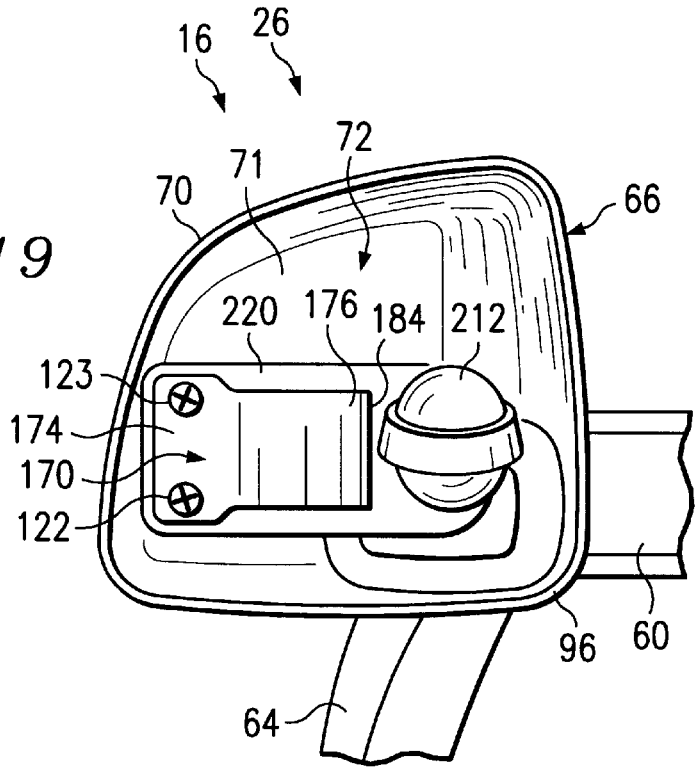
FIG. 19 is a bottom view of the back foot of FIG. 12 showing the plate including a frame-mount portion coupled to bracket and an opposite tip positioned to lie adjacent to the caster to bias the bracket to a predetermined position.
Figure 20:
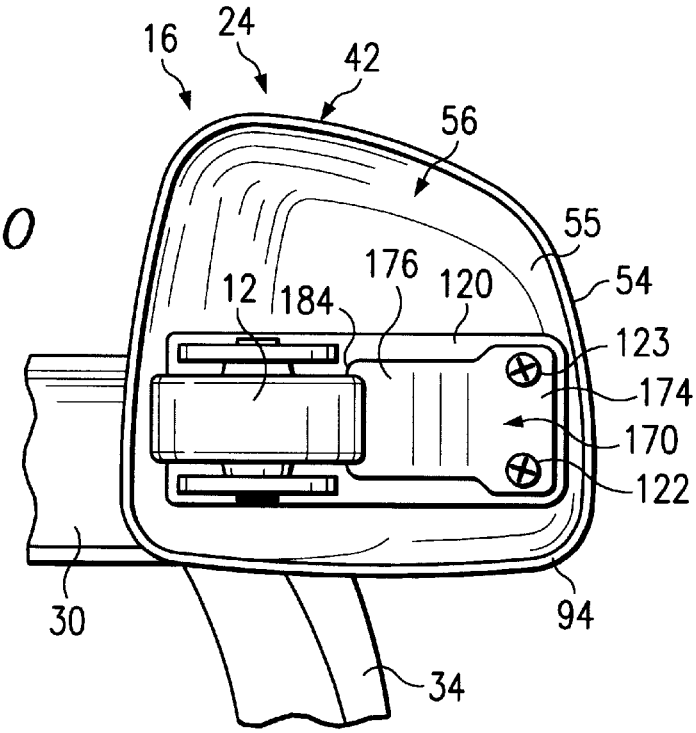
FIG. 20 is a bottom view of the front foot of FIG. 13 showing the roller mount including opposite tabs and the wheel coupled to the tabs.

Rollers 212, being casters, permit rotational movement of back legs 60, 62 relative to front legs 30, 32 when bottom surfaces 94, 96 are positioned to lie at a predetermined distance X above the floor. When bottom surfaces 94, 96 are positioned at the predetermined distance X, chair 210 is positioned to lie in a ready-to-move position as shown in FIGS. 16 and 18. Thus, back legs 60, 62 do not have to be manually raised off floor 14 by caregiver 13 in order to roll high chair 210 upon rollers 12, 212.

Figure 14:
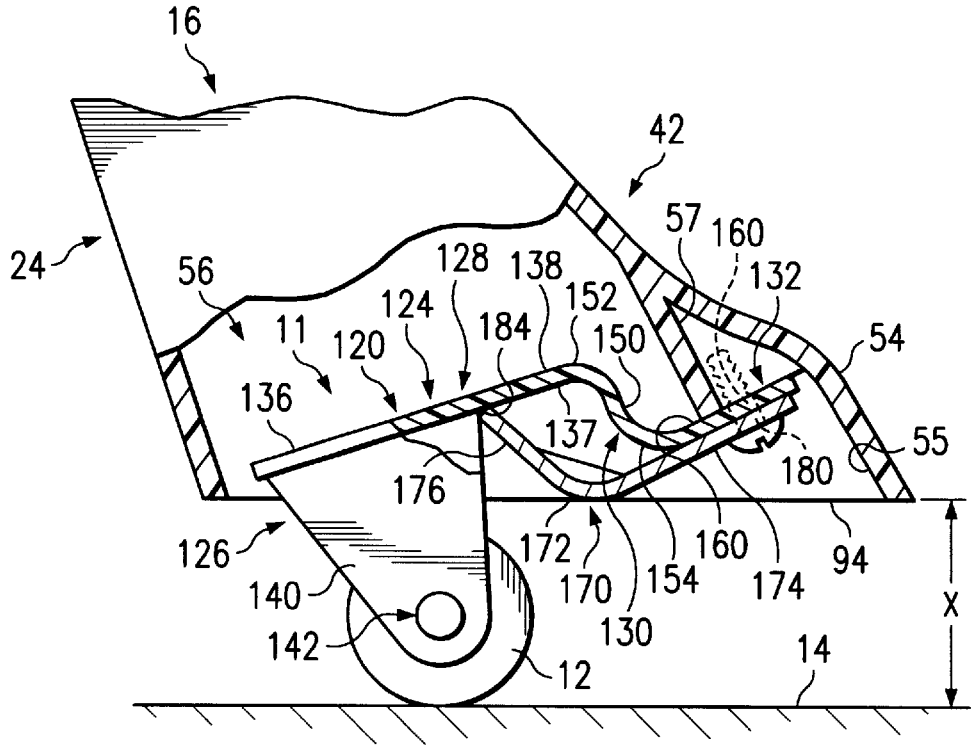
FIG. 14 is an enlarged side view of one of the front feet of FIG. 11, with portions broken away, showing the front foot including an inner wall defining the cavity, a bracket including a frame mount coupled to the inner surface and a roller mount extending from the frame mount through the cavity, the roller being a wheel coupled to the roller mount, and a plate coupled to the frame mount of the bracket to preload the bracket to a predetermined position to support the front foot at a predetermined distance above the floor.
Figure 15:
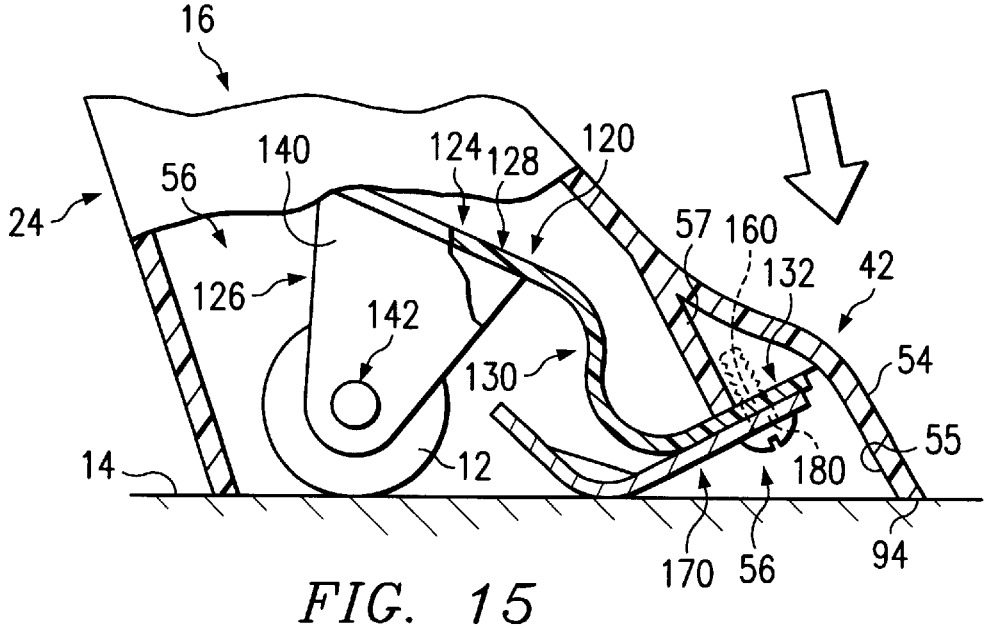
FIG. 15 is a view similar to FIG. 14 showing the roller being retracted into the cavity of the front foot after the frame has moved downwardly, the bracket flexing upwardly away from the plate to allow a bottom surface of the foot to rest upon the floor.
Figure 17:
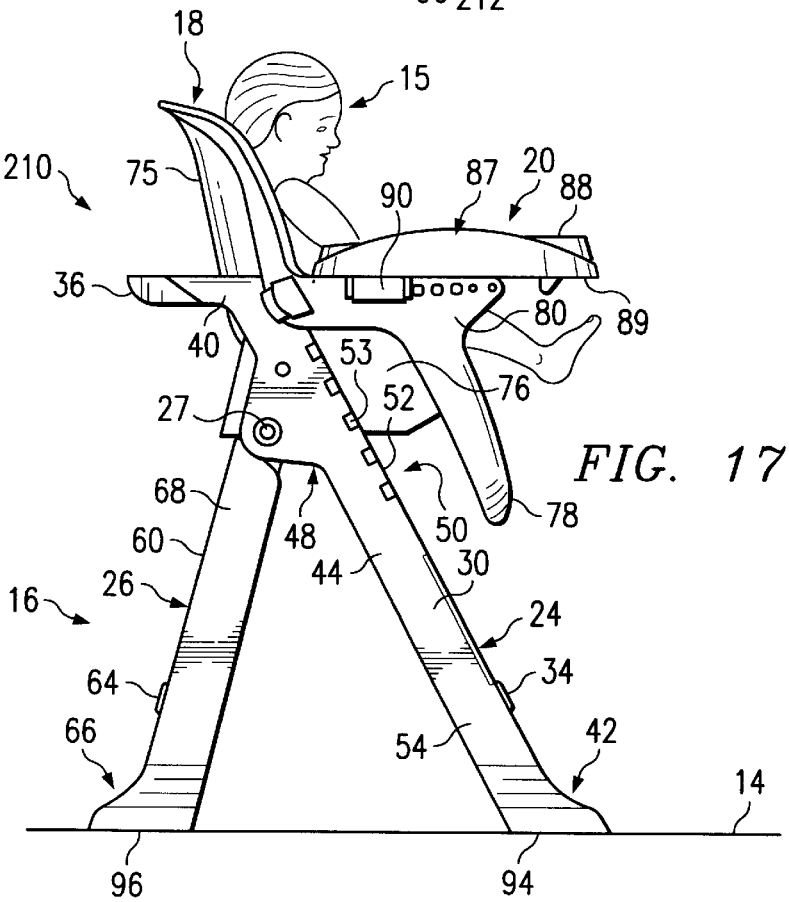
FIG. 17 is a view similar to FIG. 16 showing the seat of the high chair being occupied by a juvenile, the weight of the juvenile causing the frame to move downwardly, the rear casters to retract within the cavities of the back feet, and the front wheels to retract within the cavities of the front feet, the occupied chair thus being in a fixed position with the front and back feet resting on the floor.

Like rollers 12 (e.g., wheels) on front feet 42, 43, shown in FIG. 15, rollers 212 (e.g., casters) on back feet 66, 67 retract to a retracted position, as shown in FIG. 13, upon insertion of weight upon high chair 210, as shown for example in FIGS. 13 and 17. In the retracted position, bracket 220 flexes away from plate 170 to allow roller 212 to retract into cavity 72. Thus, bottom surfaces 96 of rear feet 66, 67 rest on floor 14. Front rollers 12 operate in the same manner and are shown in FIGS. 14 and 15.

Although high chair 10 is shown to have rollers 12 (e.g., wheels) mounted to front feet 42, 43 and no rollers mounted to back feet 66, 67 (FIG. 1) and high chair 210 is shown to have rollers 12 (e.g., wheels) mounted to front feet 42, 43 and rollers 212 (e.g., casters) mounted to back feet 66, 67 (FIG. 11), a number of other embodiments which are not shown are within the scope of this invention. For example, a high chair having casters mounted to both the front feet and the back feet is contemplated by the present invention. In addition, a high chair having any combination of wheels and/or casters mounted to the front and/or back feet is contemplated. Furthermore, plate 170 is not required for the present invention. Thus, any type of roller may be mounted to front feet 42, 43 and/or back feet 66, 67 using any type of bracket without using plate 170 to pre-load the bracket.

Although the invention has been described with reference to certain embodiments, variations exist within the scope and spirit of the invention as described and defined in the following claims.

What is claimed is:

1. A juvenile high chair comprising a frame including a front frame member and a rear frame member coupled to the front frame member, the front and rear frame members each having a foot, each foot being formed to include a cavity and including a bottom surface defining an opening into its cavity, a seat slidably mounted to the front frame member, a bracket coupled to one of the feet and normally extending through the opening in a projected position and being movable into the cavity to a retracted position upon placement of a juvenile in the seat, a roller coupled to the bracket, the roller having a portion spaced-apart from the cavity of the respective foot when the bracket is in the projected position and positioned within the cavity when the bracket is in the retracted position, and means for coupling the roller to the respective foot.

2. The high chair of claim 1, wherein the bracket includes a frame mount having an inner end coupled to the foot, an outer end, and a flexible center portion extending between the inner and outer ends.

3. The high chair of claim 2, wherein the center portion is generally Z-shaped.

4. The high chair of claim 2, wherein the bracket includes a roller mount coupled to the outer end of the frame mount.

5. The high chair of claim 1, wherein the front frame member and the rear frame member each has another foot, and further comprising a roller for each foot and means for coupling each roller to its companion foot.

6. The high chair of claim 1, wherein the roller is free to swivel about an axis perpendicular to an axis of rotation of the roller.

7. A juvenile high chair comprising a frame including a front frame member having a foot, the foot formed to include a cavity and including a bottom surface defining an opening into the cavity, a seat coupled to the front frame member, a bracket coupled to the foot and normally extending through the opening in a projected position and being movable into the cavity to a retracted position upon placement of a juvenile in the seat, and a roller coupled to the bracket, the roller having a portion spaced-apart from the cavity of the foot when the bracket is in the projected position and positioned within the cavity when the bracket is in the retracted position, the bracket including a frame mount having an inner end coupled to the foot, an outer end, and a flexible center portion extending between the inner and outer ends, the bracket including a roller mount coupled to the outer end of the frame mount, the roller mount including spaced-apart tabs, the roller being positioned to lie between the tabs.

8. A juvenile high chair comprising a frame including a front frame member having a foot, the foot formed to include a cavity and including a bottom surface defining an opening into the cavity, a seat coupled to the front frame member, a bracket coupled to the foot and normally extending through the opening in a projected position and being movable into the cavity to a retracted position upon placement of a juvenile in the seat, a roller coupled to the bracket, the roller having a portion spaced-apart from the cavity of the foot when the bracket is in the projected position and positioned within the cavity when the bracket is in the retracted position, the bracket including a frame mount having an inner end coupled to the foot, an outer end, and a flexible center portion extending between the inner and outer ends, and a plate having a frame mount portion coupled to the inner end of the frame mount of the bracket and an opposite portion engaging the outer end of the frame mount of the bracket when the roller is in the projected position and disengaging the bracket when the roller is in the retracted position.

9. The high chair of claim 8, wherein the plate is arranged to preload the bracket to maintain the bracket in the projected position until a force greater than that of the weight of the high chair is applied to the high chair urging the bracket towards the retracted position.

10. The high chair of claim 8, wherein the bracket and the plate are formed from the same piece of polycarbonate material and are separated by a living hinge.

11. A juvenile high chair comprising a frame including a front frame member having a pair of feet, each foot including a front wall, a back wall, and side walls extending between the front and back walls and cooperating to form a cavity and defining an opening into the cavity, a seat coupled to the front frame member, brackets, each bracket including a frame mount having an inner end coupled to the side wall of one of the feet and an outer end and a roller mount coupled to the outer end of the frame mount and normally extending through the opening in a projected position and being movable into the cavity to a retracted position upon placement of a juvenile in the seat, rollers, each roller being coupled to one of the brackets, the roller being spaced-apart from the cavity of the foot when the bracket is in the projected position and positioned within the cavity when the bracket is in the retracted position, and plates, each plate having a frame mount portion coupled to the inner end of one of the frame mounts and an opposite tip portion engaging the outer end of the frame mount when the roller is in the projected position and disengaging the bracket when the roller is in the retracted position.

12. The high chair of claim 11, wherein the plates are arranged to preload the brackets to maintain the brackets in the projected position until a force greater than that of the weight of the high chair is applied to the high chair urging the rollers towards the retracted position.

13. The high chair of claim 11, wherein each bracket and a companion plate are formed from the same piece of polycarbonate material and are separated by a living hinge.

14. The high chair of claim 11, wherein the rollers are free to swivel about an axis perpendicular to an axis of rotation of the roller.

15. A juvenile high chair comprising a frame including a front frame member having an upper leg portion and a foot, the foot being formed to include a cavity and a bottom surface defining an opening into a cavity, a seat coupled to the upper leg portion of the front frame member, a bracket coupled to the foot and normally extending through the opening in a projected position and being movable into the cavity to a retracted position upon placement of a juvenile in seat, a roller coupled to the bracket, the roller being spaced-apart from the cavity of the foot when the bracket is in the projected position and positioned within the cavity when the bracket is in the retracted position, and a plate including a frame mount portion coupled to the bracket and an opposite tip portion normally engaging the bracket when the bracket is in the projected position.

16. The high chair of claim 15, wherein the bracket and the plate are formed from the same piece of polycarbonate material and are separated by a living hinge.

17. The high chair of claim 16, wherein the plate is arranged to preload the bracket to maintain the bracket in the projected position until a force greater than that of the weight of the high chair is applied to the high chair urging the bracket towards the retracted position.

18. The high chair of claim 15, wherein the frame includes a rear frame member pivotably coupled to the front frame member and having two rear feet.

19. A juvenile high chair leg comprising a foot including a bottom edge adapted to engage a surface underlying the foot and a front wall, a rear wall, and a pair of side walls interconnecting the front and rear walls, the front wall, the rear wall, and the pair of side walls being arranged to form a roller-receiving cavity, a roller unit including a roller mount and a roller, and a roller support made of a spring material and coupled to the roller unit to allow the roller unit to move relative to the foot between a disabled position wherein the roller unit is positioned to lie inside the roller-receiving cavity and a rolling position wherein a portion of the roller is positioned to lie outside the roller-receiving cavity and in spaced-apart relation to the bottom edge of the foot so that the roller is adapted to engage the surface, the roller support having a first end coupled to one of the front wall, the rear wall, and the pair of side walls and a second end coupled to the roller mount.

20. The juvenile high chair leg of claim 19, wherein the roller support further includes a middle, flexible portion that has a generally Z-shaped longitudinal cross-section and interconnects the first and second ends of the roller support.

21. The juvenile high chair leg of claim 19, wherein the foot includes a fastening mount coupled to one of the front wall, the rear wall, and the pair of side walls of the foot and having an end surface, the first end of the roller support being fixedly coupled to the end surface of the fastening mount to permit pivotable movement of the roller unit about the first end of the roller support.

22. The juvenile high chair leg of claim 21, wherein the first end of the roller support includes an upper surface that abuts the end surface of the fastening mount and is perpendicular to a longitudinal axis of the fastening mount.

23. The juvenile high chair leg of claim 21, wherein the second end of the roller support is positioned to lie in spaced-apart relation to the foot.

24. A juvenile high chair leg comprising a foot arranged to form a roller-receiving cavity and a bottom edge adapted to engage a surface underlying the foot, a roller unit including a roller mount and a roller, a roller support made of a spring material and coupling the roller unit to the leg to allow the roller unit to move relative to the foot between a disabled position wherein the roller unit is positioned to lie inside the roller-receiving cavity and a rolling position wherein at least a portion of the roller is positioned to lie outside the roller-receiving cavity and in spaced-apart relation to the bottom edge of the foot so that the roller is adapted to engage the surface, and a second support having a first end coupled to the leg and an opposite, second end positioned to engage the roller support and limit movement of the roller away from the bottom edge of the foot beyond a predetermined maximum distance in the rolling position.

25. The juvenile high chair leg of claim 24, wherein the second end of the support blocker includes an abutment surface that abuts the roller support when the roller is positioned at the predetermined maximum distance from the bottom edge of the foot, the abutment surface being positioned to lie in spaced-apart relation to the roller support when the roller is positioned in the disabled position.

26. The juvenile high chair leg of claim 25, wherein the support blocker includes a curved portion interconnecting the first and second ends of the support blocker such that the second end of the support blocker is positioned to lie at an obtuse angle relative to the first end of the support blocker.

27. The juvenile high chair leg of claim 26, wherein the support blocker is made of a rigid material and is fixedly coupled to the foot.

28. The juvenile high chair leg of claim 25, wherein the foot includes a fastening mount, the roller support including a first end fixedly coupled to the fastening mount and the first end of the support blocker such that the first end of the roller support is sandwiched between the fastening mount and the first end of the support blocker, a second end coupled to the roller unit, and a flexible, generally Z-shaped portion interconnecting the first and second ends of the roller support, the abutment surface of the support blocker abutting the second end of the roller support when the roller is positioned at the predetermined maximum distance from the bottom edge of the foot.

29. The juvenile high chair leg of claim 28, wherein the support blocker and the roller support cooperate to form a parallelogram when the abutment surface of the second end of the support blocker abuts the second end of the roller support.

30. A juvenile high chair leg comprising a foot arranged to form a roller-receiving cavity and a bottom edge adapted to engage a surface underlying the foot, a roller unit including a roller mount and a roller, a roller support made of a spring material and coupled to the roller unit to allow the roller unit to move relative to the foot between a disabled position wherein the roller unit is positioned to lie inside the roller-receiving cavity and a rolling position wherein a portion of the roller is positioned to lie outside the roller-receiving cavity and in spaced-apart relation to the bottom edge of the foot so that the roller is adapted to engage the surface, and a second support having a first end coupled to the roller support and an opposite, second end positioned to preload the roller support when the roller unit is positioned to lie at a predetermined maximum distance from the bottom edge of the foot.

31. The juvenile high chair leg of claim 30, wherein the second end of the second support includes an abutment surface that is positioned to lie in spaced-apart relation to the foot and abuts the roller support to preload the roller support when the roller unit is positioned to lie at the predetermined maximum distance from the bottom edge of the foot.

32. The juvenile high chair leg of claim 31, wherein the abutment surface of the second support is positioned to lie in spaced-apart relation to the roller support when the roller unit is in the disabled position.

33. The juvenile high chair leg of claim 31, wherein the second support includes a curved portion positioned to lie between the first and second ends of the second support such that and the first and second ends of the second support slope upwardly away from the curved portion and form an obtuse angle therebetween.

34. A juvenile high chair including at least one leg, the leg comprising:

a foot having a bottom edge adapted to engage a surface underlying the foot;

a roller; and a bracket having a first end coupled to the leg, a second end coupled to the roller and a center flexible portion extending between the first and second ends, the first and second ends being substantially parallel to each other when a portion of the wheel engages the surface and displaces the bottom edge of the leg from the surface.

* * * * *